US007921938B2

(12) United States Patent
Berger et al.

(10) Patent No.: US 7,921,938 B2
(45) Date of Patent: Apr. 12, 2011

(54) COMMAND AND CONTROL FOR BORING SYSTEM

(75) Inventors: W. Andrew Berger, Clarks Summit, PA (US); Robert A. Spalletta, Scranton, PA (US); Jerry A. Carter, Clarks Green, PA (US); Richard M. Pell, Dalton, PA (US); Marian Mazurkiewicz, Dallas, PA (US)

(73) Assignee: The University of Scranton, Scranton, PA (US)

( * ) Notice: Subject to any disclaimer, the term of this patent is extended or adjusted under 35 U.S.C. 154(b) by 460 days.

(21) Appl. No.: 11/886,375

(22) PCT Filed: Mar. 30, 2006

(86) PCT No.: PCT/US2006/011934

§ 371 (c)(1),
(2), (4) Date: Nov. 7, 2008

(87) PCT Pub. No.: WO2006/105404

PCT Pub. Date: Oct. 5, 2006

(65) Prior Publication Data

US 2009/0090553 A1 Apr. 9, 2009

Related U.S. Application Data

(60) Provisional application No. 60/666,970, filed on Mar. 31, 2005.

(51) Int. Cl.
*E21B 44/00* (2006.01)

(52) U.S. Cl. ..... 175/26; 299/1.05; 340/853.1

(58) Field of Classification Search ..... 175/26, 175/24; 299/1.05, 1.1, 30; 340/853.1, 853.6, 340/853.3, 853.4, 856.1; 166/53
See application file for complete search history.

(56) References Cited

U.S. PATENT DOCUMENTS

| | | | | |
|---|---|---|---|---|
| 4,554,982 | A * | 11/1985 | Burton | 175/75 |
| 5,295,546 | A * | 3/1994 | Giannesini et al. | 166/353 |
| 6,250,402 | B1 * | 6/2001 | Brune et al. | 175/45 |
| 6,308,787 | B1 * | 10/2001 | Alft | 175/48 |
| 2004/0182574 | A1 * | 9/2004 | Adnan et al. | 166/250.01 |

* cited by examiner

*Primary Examiner* — Daniel P Stephenson
(74) *Attorney, Agent, or Firm* — Charles L. Riddle; Riddle Patent Law

(57) ABSTRACT

A system having a number of land units [100, 4000, 5000] is disclosed which operates to efficiently find and create boreholes [5] to one or more underground targets [1]. Each of the land units [100, 4000, 5000] may be remotely controlled from a central command unit [6000]. The land unit also may be self-controlled, or partially controlled by the central command unit [6000]. The system [10] is reconfigurable to reallocate tasks to functional land units [100, 4000, 5000] which were originally allocated to land units which have been destroyed and are now non-functional.

16 Claims, 6 Drawing Sheets

COMMAND AND CONTROL FOR BORING SYSTEM

CROSS REFERENCE TO RELATED APPLICATIONS

The present application claims priority from U.S. Provisional Patent Application "The Archimedes Javelin" by Wojciech Andrew Berger, Robert A. Spalletta, Jerry A. Carter, Marian Mazurkiewicz, Richard M. Pell, Christopher Davey, Ser. No. 60/666,970 filed Mar. 31, 2005. It is also related to PCT Applications "System for Rapidly Boring Through Materials" by Wojciech Andrew Berger, Robert A. Spalletta, Jerry A. Carter, Marian Mazurkiewicz, Richard M. Pell, Christopher Davey and "Multiple Pulsejet Boring Device" by Wojciech Andrew Berger, Robert A. Spalletta, Jerry A. Carter, Richard M. Pell, Marian Mazurkiewicz. It is also related to PCT Application "Cryogenic Pulsejet" by Robert A. Spalletta. The PCT applications were all mailed Mar. 23, 2006. All of the above applications are hereby incorporated by reference as if set forth in their entirety herein.

BACKGROUND OF THE INVENTION

1. Field of the Invention

The present invention relates to command and control of a system for coordinating multiple land units which rapidly bore small diameter access holes through the ground materials to specified locations.

2. Discussion of Related Art

In various emergency situations, it is necessary to quickly and accurately provide an access hole to underground voids or objects. In situations where miners are trapped beneath the surface, speed is critical to provide air, or to pump out ground water to keep them alive. This would be the first step in the rescue operations.

Speed is also critical in other emergency situations such as in neutralizing underground terrorist weapons or bunkers. These must be neutralization before the enemy can take countermeasures.

In the case of an underground weapon or bunker, the prior art solution was to drop bunker-busting "bombs" on the surface above the underground target. These typically may be buried under up to 100 m of earth and stone.

Obviously, the prior art bombing techniques would not be suitable in situations where one would like to recover people, devices, materials, and information in the bunker unharmed. Therefore, underground rescue attempts for people trapped underground, such as miners or earthquake victims would have to use other means.

Also, these prior art methods would not be appropriate in situations where one would like to recover devices, materials, and information intact and undamaged, that were stored underground, such as in an underground bunker.

There are systems which employ single drilling units, or a number of these single drilling systems. Since these are not designed to coordinate with each other, it is simply several systems drilling without coordination, communication or interaction with the other systems.

The system is intended to be deployed in rough or inaccessible terrain. In rough mountainous terrain, they may fall into trees, off cliffs, or roll down steep inclines.

In the case of an earthquake, the roads and bridges are destroyed. In the case of a battle scenario, the roads and bridges are destroyed, and in addition, there are enemy entities trying to disable the drilling units.

Due to the above problems, the systems may be dropped from aircraft. In this deployment, there is the additional problem of being destroyed on impact.

If each is pre-programmed to image a region and bore to a given target, if one is lost, so is the imaging relating to region for which this was programmed. Also, since this unit is disabled, it will not be boring to its pre-programmed target.

Therefore, there is a current need for a fast, efficient method of using multiple land units to rapidly image and bore to underground objects or voids.

SUMMARY OF THE INVENTION

One embodiment of the present invention is a system [10] for rapidly boring though a material to a desired target location comprising:

a) central command unit [6000];

b) a plurality of ground units for boring a hole to a target location, each unit having a platform [1000], umbilical subsystem [2000], a boring subsystem [3000] with a boring head [3200], a plurality of sensors [1810, 2810] and actuators [2100] throughout the system, and a computing unit [1910] adapted to operate in the following modes:

i. an auto mode in which the computing unit [1910] of each ground unit [100, 4000, 5000] performs any sensing and actuating functions;

ii. a remote-controlled mode in which the central command unit [6000] controls the computing unit [1910] and its sensing and actuation functions from a remote location; and iii. a mixed mode in which the computing unit [1910] of each ground unit [100, 4000, 5000] performs sensing and actuating functions, and the central command unit [6000] may remotely adjust or override the sensing and actuation functions.

The present invention may also be embodied as a system [10] for rapidly boring though a material to a desired target location comprising:

a) central command unit [6000];

b) a plurality of ground units for boring a hole to a target location, each unit having a platform [1000], umbilical subsystem [2000], a boring subsystem [3000] with a boring head [3200], a plurality of sensors [1810, 2810] and actuators [2100] throughout the system, and a computing unit [1910] having initial pre-stored tasks to image a defined underground region and to bore to a defined underground location [1].

OBJECTS OF THE INVENTION

It is an object of the present invention to provide a system of remote controlled land units for rapidly finding and boring access holes to underground objects and/or voids ("targets").

It is another object of the present invention to provide a system of land units capable of automatically rapidly finding and boring access holes to targets.

It is another object of the present invention to provide a system of land units capable of automatically rapidly finding and boring access holes to targets which may be overridden by a remote central command unit.

It is another object of the present invention to provide a system of land units capable of automatically reallocating tasks to be performed when a land unit is destroyed or disabled.

It is another object of the present invention to provide a reconfigurable system of land unit for rapidly finding and aiding in the rescue of people trapped underground.

It is another object of the present invention to provide a resilient, reconfigurable system of land units for rapidly neutralizing underground weapons and bunkers.

It is still another object of the present invention to provide a reconfigurable system of land units for rapidly boring holes horizontally under roads, highways, or buildings.

BRIEF DESCRIPTION OF THE DRAWINGS

The advantages of the instant disclosure will become more apparent when read with the specification and the drawings, wherein.

DETAILED DESCRIPTION OF THE INVENTION

All elements not specifically described herein have the same function as described in the applications incorporated by reference above.

Figure 1:
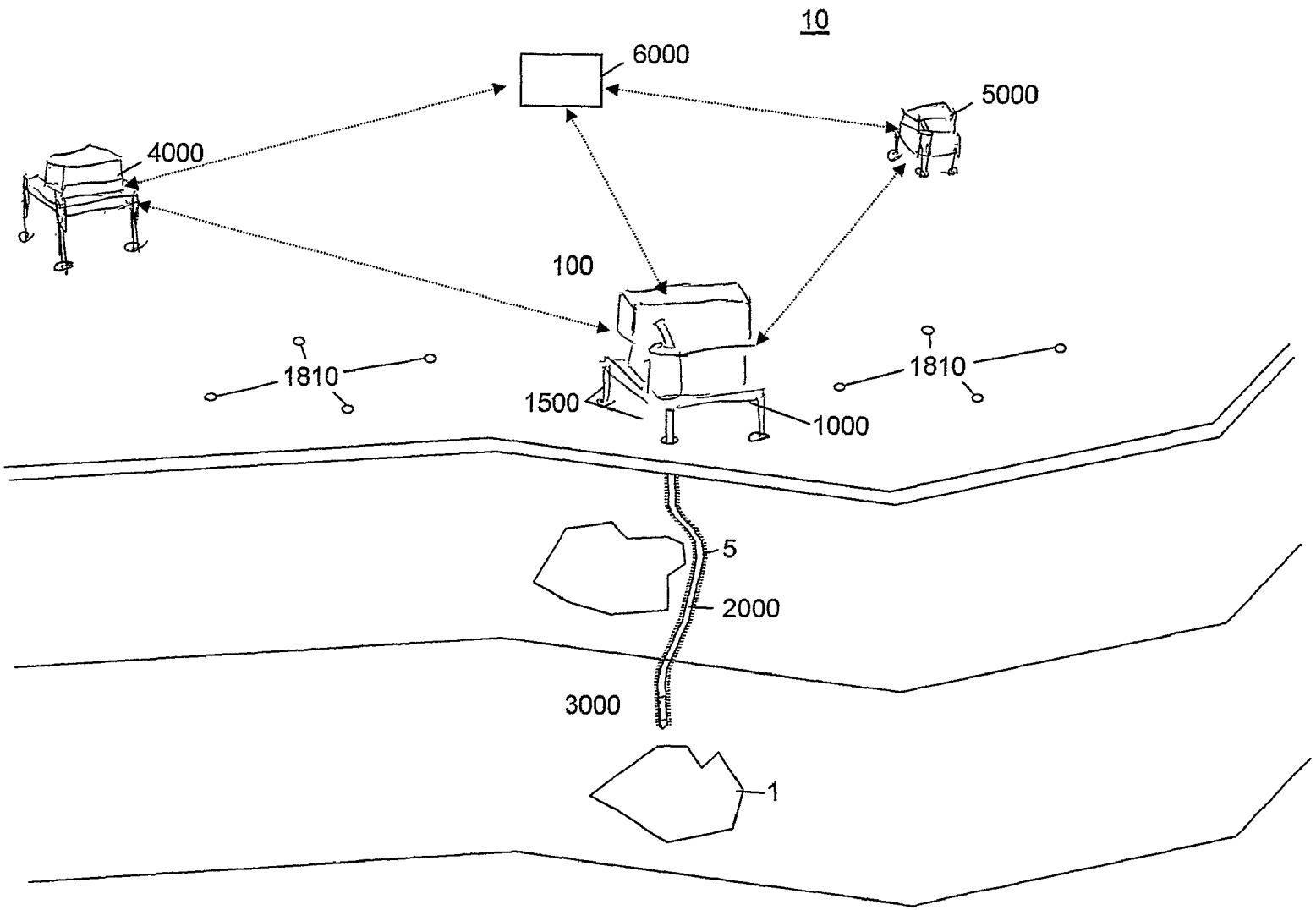
FIG. 1 is a perspective view of several coordinated ground units according to one embodiment of the present invention, as they appear in operation.

An embodiment of the present invention is shown in perspective view in FIG. 1. A plurality of ground units 100, 4000, 5000 are deployed on the ground and positioned near their intended targets which may be underground voids or objects. Land unit 100 is shown positioned above target 1. Ground units 100, 4000, 5000 may be delivered there by a number of different conventional known methods including an air-drop for inaccessible locations.

A plurality of seismic sensors 1810 may be attached to ground units 100, 4000, 5000 or scattered on the ground. These may sense phenomena and send it back to the ground units 100, 4000, 5000 or central control unit 6000 via telemetry.

A central command unit 6000 may be located remotely at a land base, ship based or located on an aircraft. The land units 100, 4000, 5000 and central command unit 6000 communicate with each other.

Ground unit 100 employs a platform subsystem 1000 having retention and orientation devices 1500 which secure ground unit 100 to the ground and tilts platform 1000 to an optimum orientation for boring to target 1. Platform subsystem 1000 is designed to hold, store and carry all the equipment during deployment, initiate boring of an access hole, hold materials to be used in a fuel reservoir, stabilize ground unit 100 for boring, and communicate with other units.

A boring subsystem 3000 bores down through the ground toward target 1, creating an access hole 5. Boring subsystem 3000 is designed to force the excavated materials out of the access hole 5 and to the surface.

Boring subsystem 3000 is connected to platform subsystem 1000 by an umbilical subsystem 2000.

Umbilical subsystem 2000 connects the Platform 1000 and Boring 3000 subsystems. It acts to pass materials, electricity, and control signals between platform 1000 and boring 3000 subsystems.

Umbilical subsystem 2000 also employs a number of sensors and actuators.

Mechanical actuators absorb much of the forces produced during boring, as well as for steering and advancing umbilical subsystem 2000 and boring 3000 subsystems deeper into the access hole 5. Each subsystem is described in greater detail below.

Loss of Land Units

Since these land units 100, 4000, 5000 are used in emergency situations, which need to be deployed quickly, or are used in inaccessible areas, as stated above, they may be air dropped. The land units may hit trees, fall down canyons, off cliffs, or impact hard rock faces upon deployment. Some land units may be destroyed or inactivated.

In the interest of speed and efficiency, each land unit is programmed with certain tasks. In one embodiment, they operate in parallel, each covering a specific region. This may include, providing sonic shock waves to the ground, receiving reflected sonic waves, transmitting and/or receiving other signals. The land unit may also be responsible for processing information which is used by at least one other land unit, or central command unit 6000.

Therefore, if this land unit is disabled, the above functions will not be performed without reconfiguration of the system.

To understand their high level function control and allocations, it is important to understand the systems and functioning of each ground unit 100, 4000, 5000.

Platform Subsystem

Platform subsystem 1000 is shown and described in connection with FIGS. 2 and 3. Platform 1000 carries all the devices of ground unit 100 to an intended location. The umbilical subsystem 2000 employs elements as described in the "Cross Reference to Related Applications", above with any additional elements and functionality described herein.

One or more pumps (not shown) may be required to pump the energetic fluid 7 (and also the payload fluid) through umbilical subsystem 2000 to boring system 3000.

There are sensors which monitor the functioning of the pumps, the flow of one or more fluids and the pressure and levels of the fluid reservoir and other reservoirs.

Umbilical Subsystem

The umbilical subsystem performs four key functions during the mission: (a) acting as a structural member assuring constant descent; (b) acting as a conduit for the energetic fluid 7 from the platform 1000 to boring subsystem 3000, (c) acting as a stable platform for propulsion and steering actuators mounted at intervals on the outer umbilical surface, and (d) acting as a delivery pump for pumping life-support or neutralizing materials from platform 1000. The umbilical subsystem 2000 employs elements as described in the "Cross Reference to Related Applications", above with any additional elements and functionality described herein.

Figure 4:
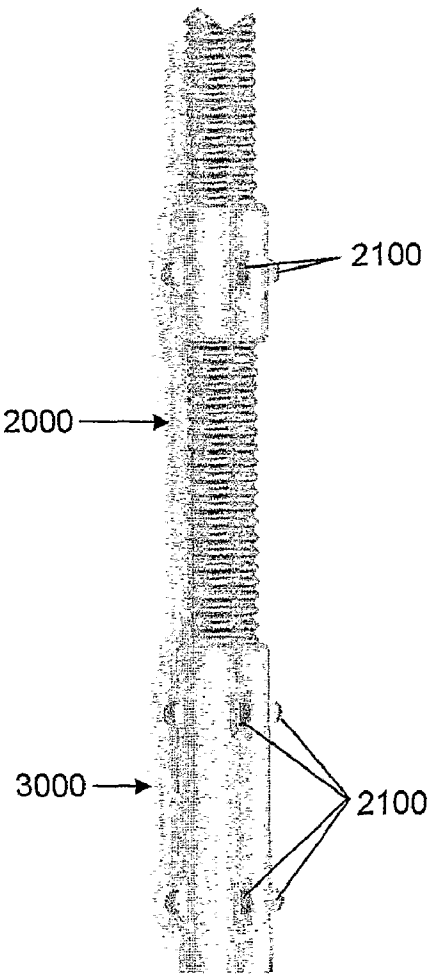
FIG. 4 is a side elevational view of an embodiment of the umbilical subsystem and the boring subsystem according to the present invention.
Figure 5:
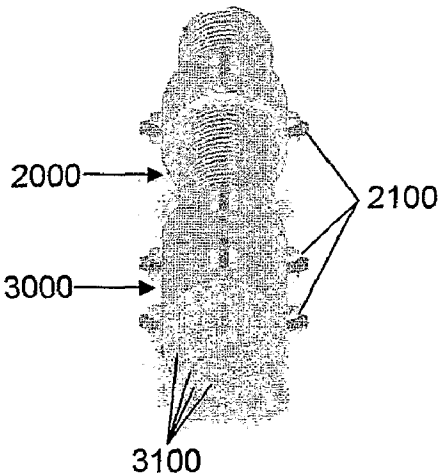
FIG. 5 is a perspective view of the umbilical subsystem and the boring subsystem of FIGS. 1, 2 and 4.

One embodiment of the umbilical subsystem 2000 according to the present invention is shown in perspective views in FIGS. 4 and 5. Here it can be seen that the umbilical subsystem 2000 is designed to be flexible. Umbilical subsystem

2000 attaches to, and carries boring subsystem 3000 having a plurality of pulsejets 3100 located at its distal end.

Figure 6:
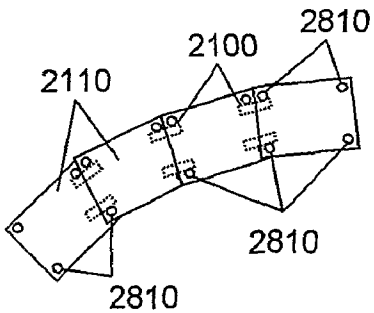
FIG. 6 is an enlarged partial illustration of one embodiment of the umbilical subsystem according to the present invention.

In FIG. 6, the umbilical subsystem 2000 is shown constructed from a flexible material or a plurality of articulating segments 2110. These segments 2110 may partially fit inside, and be pulled out from adjacent segments, thereby reducing and increasing the length of umbilical subsystem 2000, respectively. These may also be inserted into the adjacent umbilical segment 2110 in an uneven manner causing the umbilical to curve in a desired direction.

Each segment 2110 has hydraulic, pneumatic, artificial muscle, fluid driven or other mechanical actuators 2100. Therefore, the segments 2110 may be selectively pulled into, or extended from adjacent segments thereby causing the umbilical subsystem 2000 to lengthen, shorten, or to curve in a given direction.

The umbilical sensors and actuators are used here for descriptive purposes, however, sensors and actuators will be used throughout the system. When one of these actuators or sensors is mentioned, it is to be understood that the same will apply to other sensors and actuators of the system.

Umbilical Actuators

The actuators 2100 in the umbilical 2000 control propulsion, guidance, steering, stabilization, debris conveyance and umbilical rigidity.

Each segment or portion of the umbilical 2110 may also employ an electro-viscous material which can be individually actuated. An electro-viscous material is one which changes its viscosity when an electric current is passed through it. These may also be compartmentalized with a flexible skin or in separate segments 2110. Then, sections/portions may be operated to have selected rigidity allowing the umbilical to be pushed or pulled through the borehole 5. The electro-viscous compartments are also considered umbilical actuators 2100.

Therefore, actuation of the umbilical actuators 2100 is implemented as a small implementation of umbilical actuators 2100 for a plurality of segments 2100 in three dimensions.

Similarly, resulting stiffness at the end of umbilical subsystem 2000 is a function of the stiffness of each segment over the length of the umbilical.

Similarly, the actual 3-dimensional location of the end of the umbilical 2000 is the summation of the individual locations from the individual umbilical sensors 2810 of each segment, integrated over the segments of the umbilical.

Therefore, actuation of the umbilical 2000 must take these conditions into account to move the end to the proper location, or maintain the proper stiffness of the umbilical 2000 over a given section of its length.

Umbilical Sensors

The umbilical sensors 2810 monitor stresses, strains, temperature,

The umbilical sensors 2810 will monitor the state of actuators, position, orientation, velocity, acceleration, inclination, pressure, stress, strain, vibration, fluid 7 flow through fluid conduit 2900, flow through exhaust conduit 2500, umbilical rigidity and integrity. They may also monitor chemical and radioactive characteristics of the ground.

The components of the sensors and actuators will be designed to withstand high temperatures and other harsh environments.

Boring Subsystem

Figure 7:
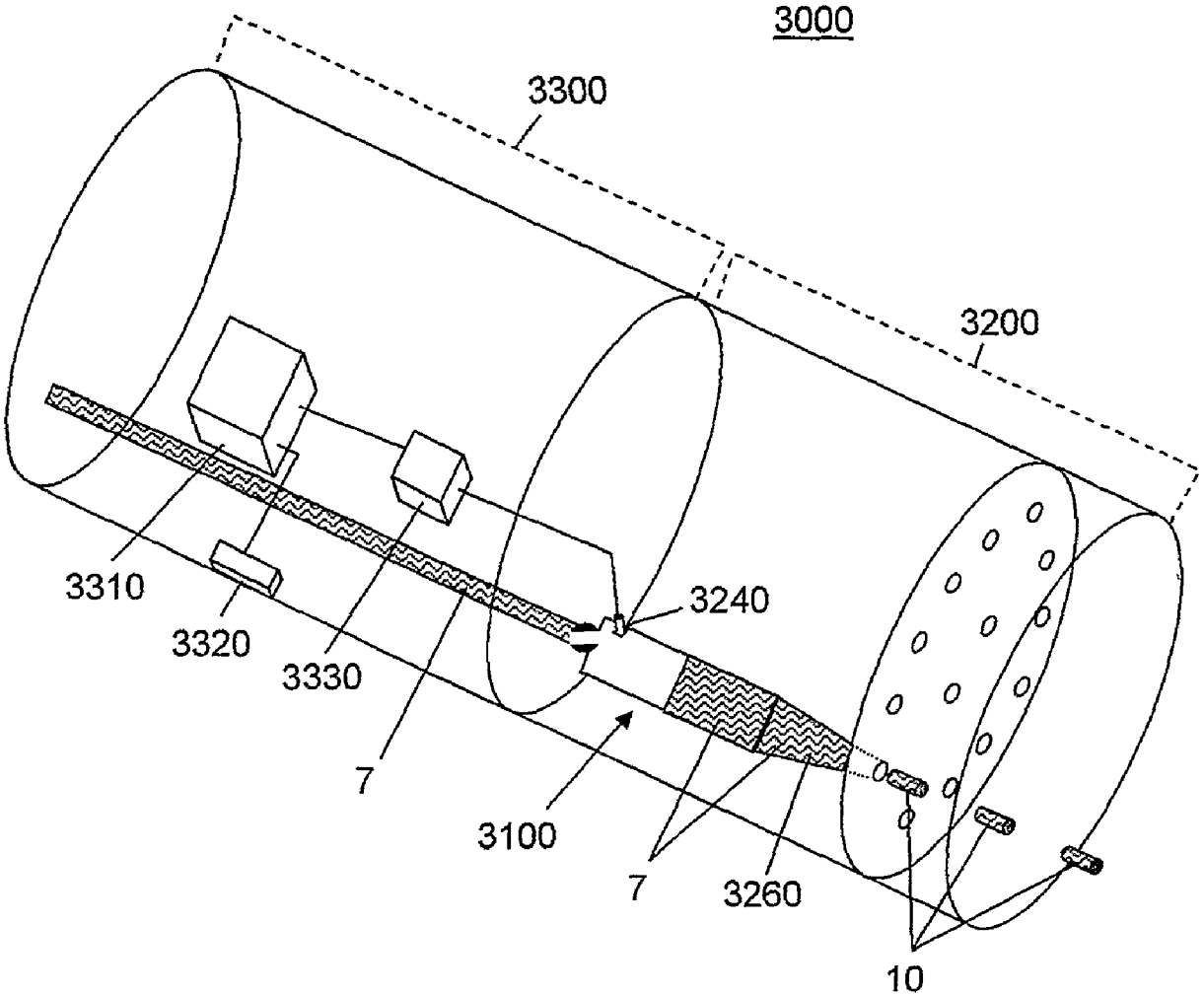
FIG. 7 is a perspective view of one embodiment of a boring subsystem showing a plurality of pulsejets according to the present invention.

FIG. 7 is a perspective view of one embodiment of a boring subsystem 3000 according to the present invention. The end of the boring subsystem 3000 is a boring head 3200 containing ten to twenty pulsejets 3100. The boring subsystem 3000 employs elements as described in the "Cross Reference to Related Applications", above with any additional elements and functionality described herein. Pulsejets 3100 receive energetic fluid 7, and cause the fluid to create a rapidly expanding bubble forcing portions of the fluid out of a nozzle 3260 at high speeds as a plurality of fluid slugs 10. Since the fluid used is highly incompressible, the impact of slugs 10 bores through rock and earth.

Boring Body

A boring body 3300 behind boring head 3200 protects and houses a pulse controller 3330 for causing the ignition of the energetic fluid 7. It also encloses a sensor package 3320, for sensing physical properties related to the boring subsystem 3000.

Borehead Sensors

This sensor package 3320 will include monitoring and analysis of telemetry from sensors in the boring head 3300 and umbilical 2000 to determine the type of material the boring head 3300 is boring through, has bored through, or is about to bore through (the "geology").

The sensors package 3320 may include static/dynamic accelerometers, geophones, and gyros will sense conditions around and ahead of the boring head 3200. They may sense state of actuators, position, orientation, velocity, acceleration, inclination, pressure, stress, strain, vibration, chemical and radioactive characteristics.

The sensor package 3320 will provide information to computer control 3310 which will adjust the course by controlling and adjustment of pulsejet 3100 firing frequency, sequence and intensity. Computer control 3310 will also calculate these parameters for steering and forward progress optimization. Computer control 3310 will provide real-time solutions to control of the mechanical performance of umbilical 2000 by selectively energizing of electro-viscous umbilical actuators 2100 throughout the length and circumference of umbilical 2000.

Pulsejet Control

Computer control 3310 and pulse controller 3330 determine when to ignite the energetic fluid 7. Pulse controller 3330 causes an ignition device 3240 to ignite energetic fluid 7 in a combustion chamber 3230 at the proper instant to cause a slug 10 to be formed and fired out of nozzle 3260.

Computer control unit 3310 will also calculate when nozzle 3260 encounters target 1. By sensing physical parameters through sensor package 3320, computer control unit 3310 can detect voids, fluids, etc. in the ground near boring head 3200. This may be based upon the rate of penetration and applied pressures. Computer control unit 3310 will receive data from the sensors in sensor package 3320 and potentially interact with computing device 1910 of platform 1000 (of FIG. 1) to determine the direction which to bore to most effectively reach target 1 (of FIG. 1). The control of boring subsystem 300Q steering it toward target 1 is more fully explained in co-pending patent application entitled "Multiple Pulsejet Earth Boring Device" hereby incorporated by reference as if set forth in its entirety herein.

Imaging Devices

Referring now to FIGS. 1, 4, 5, 6, and 7, initial imaging of the target could be attained by some external underground imaging system and stored in ground unit 100 for later use. For example, seismic sensors having built in telemetry transmitters are dropped onto the ground (shown as seismic sensors 1810 of FIG. 1). A small explosion is created to cause vibrations in the ground. The sensors detect the vibrations and radio the sensed signal back to the ground units 100, 4000, 5000 and/or central command unit 6000.

The present invention may also use its own active seismic sources (1820 of FIG. 1) to determine the location, depth, and rock properties (structure and seismic velocities) of the target (1 of FIG. 1).

In one embodiment of the present invention, each land unit [100, 4000, 5000 is initialized with an initial target 1 and an initial region to image.

The imaging system would consist of a seismic source 1820 and seismic sensors 1810 located on platform 1000 (of FIG. 1). Umbilical sensors 2810 may be attached to umbilical subsystem 2000 which may also act as seismic sensors. A sensor package 3100 in boring subsystem 3000 may also include the seismic sensors.

Computing device (1910 of FIG. 2) receives the sensor output, either by hard wire, or via telemetry.

Computing device (1910 of FIG. 2) then creates an underground image showing the target and other underground features. Computing device 1910 also monitors sensors on boring subsystem 3000 and umbilical subsystem 2000 and superimposes their locations on the underground image.

Communication

Figure 2:
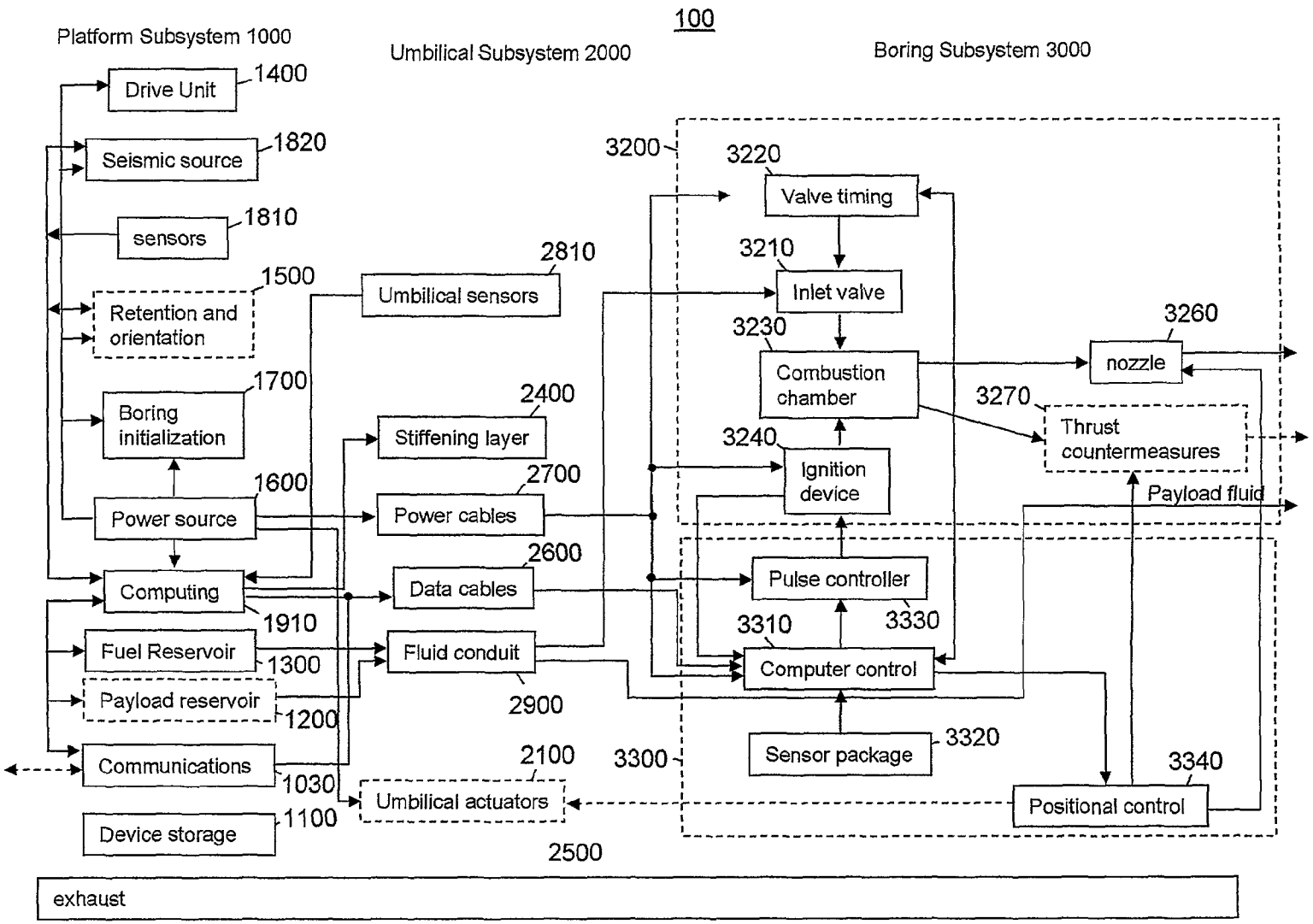
FIG. 2 is a simplified schematic block diagram of a land unit of FIG. 1 according to one embodiment of the present invention.
Figure 3:
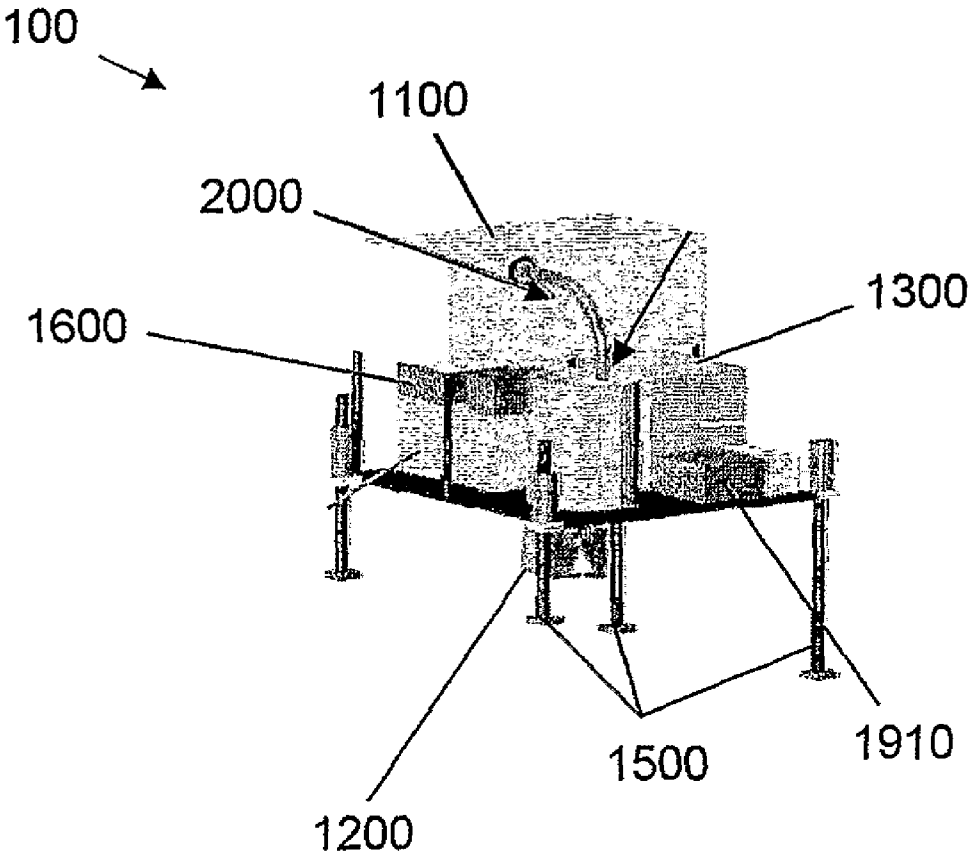
FIG. 3 is a perspective view illustrating an embodiment of the ground unit according to the present invention.

Each of the land units employs a communication unit 1030 as shown in FIG. 2. These units are capable of communicating with each other and central command unit. Communications units 1030 allow communication of data relating to commands, sensor readings, inter-computer communication as well as voice and sounds.

Each communication unit 1030 is connected to computing unit 1910 in each land unit (100, 4000, 5000 of FIG. 1) allowing communication of any information of computing unit 1910. It is also connected to the data cables 2600 permeating the system allowing direct communication with lower level devices such as actuators and sensors. Therefore, readings from sensors may be directly communicated to central command 6000. Also, commands may be directly sent to each actuator.

Distributed/Centralized Intelligence

Some decision capabilities will reside in the underground portion of the system. Intelligence may be distributed in system components such as computer control 3330 and valve timing 3220 to measure data, analyze data and interpret results. Responses should include activating other systems in response.

Referring now to FIG. 2, any computing system may break up functions to be performed and allocate them to various computing devices. There may be dedicated computing devices for each of the functions, or a main computing device may perform all of the computing functions. It is understood that this invention covers various arrangements in which the functions are allocated between the computing devices. For example, it has been described here and in the patent applications listed in "Cross Reference to Related Applications" that a computer control 3310 provides a rate to pulse controller 3330 at which a pulsejet (3100 of FIG. 7) is to be fired. The pulse controller 3330 then monitors the time which has passed since the last ignition and provides a command to the igniter at the proper time to cause the ignition. Pulse controller 3330 then continuously repeats this function. Computer control 3310 has delegated this function to the dedicated pulse controller 3330.

The system could have also been designed such that computer control 3310 counted down the time and sent the ignition command to the ignition device 3240 by itself, eliminating the pulse controller 3330.

Therefore, the computing device 1910 is running the system and delegating out several functions to dedicated computing devices.

Operation

1. Mixed Mode

Referring now to FIG. 1, the present invention as generally described above, operates in a Mixed Mode in which each land unit 100, 4000, 5000 performs its programmed tasks autonomously, but may be adjusted or overridden by the central command unit 6000. In this mode, operation of the land units 100, 4000, 5000 can be adjusted or overridden by the central command unit 6000. This may be done by sending a command from the central command unit 6000 to the computing device 1910 causing it to modify its command or providing sensor readings. Central command unit 6000 may also directly send commands to the actuators to modify, cancel, or replace commands from the computing device 1910 and read sensor readings directly from land unit 100, 4000, 5000 sensors.

2. Remote Mode

The land units 100, 4000, 5000 may operate in a "Remote Mode". In this mode, land units are placed under the direct control of robots of central command unit 6000.

Figure 8:
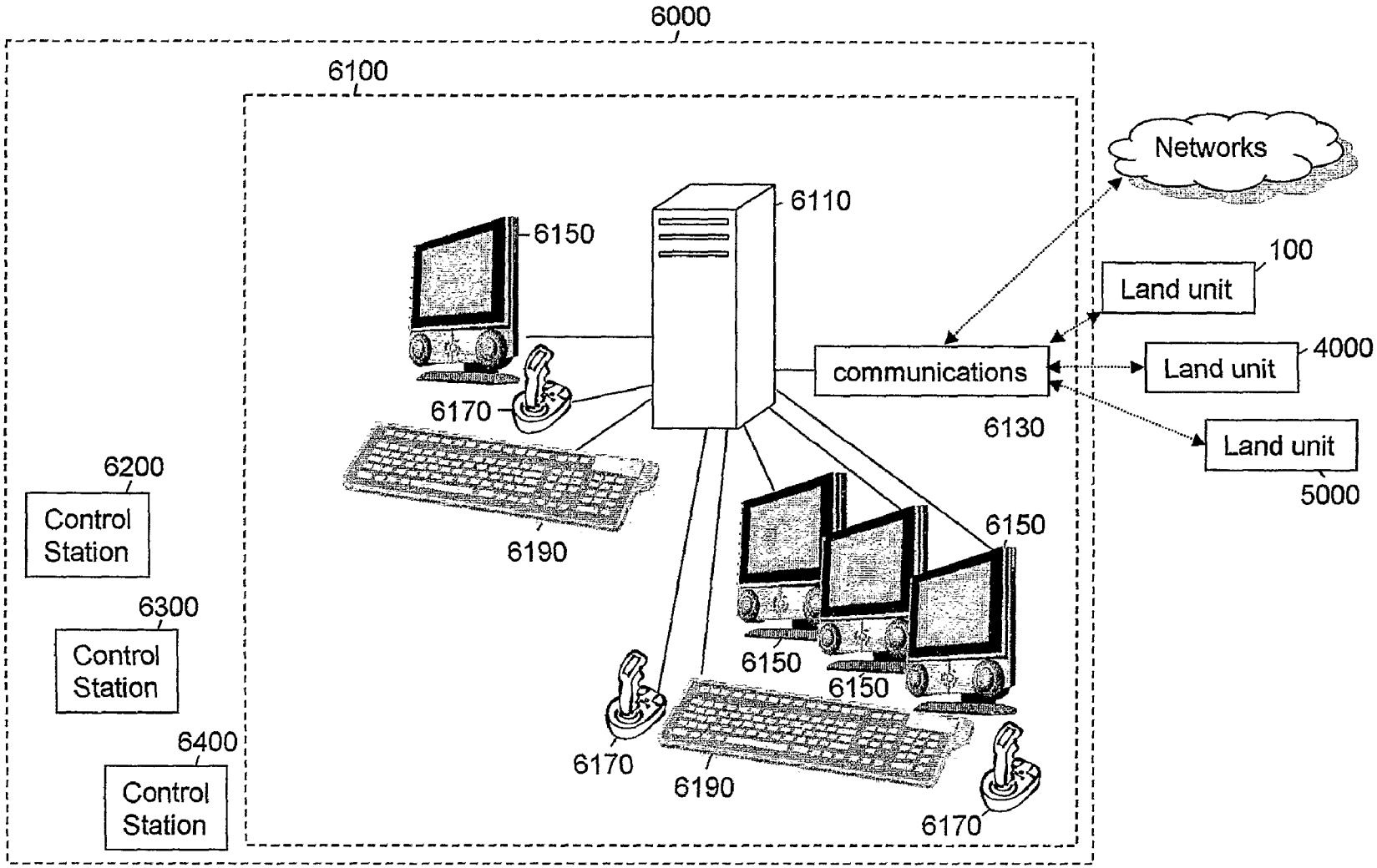
FIG. 8 is a simplified block diagram of the central command unit of FIG. 1.

FIG. 8 is a simplified block diagram of the central command unit of FIG. 1. Information from land Units 100, 4000, 5000 are communicated to Central Command Unit 6000. Central Command Unit 6000 may have one or more control stations 6100, 6200, 6300 and 6400. A control station 6100 is shown in greater detail. Communications Unit 6130 is coupled to a central processing unit (CPU) 6110. CPU 6110 is coupled to at least one monitor 6150 for displaying images to user. CPU 6110 also has input devices which may be joysticks 6170, keyboards 6190 and various other known input devices allowing the users to interact with CPU 6110.

In its operation, any information which can be sensed by sensors on land units 100, 4000, 5000 can be directed to users at control stations 6100-6400. This information may be presented to the users in the form of audio, video, text, graphic or other means. Users then select and operate any of the systems on land units 100, 4000, 5000 to remotely actuate them.

As discussed elsewhere in this application, users at central command unit 6000 can sense information from devices having the highest intelligence level through the lowest intelligence level on land Units 100, 4000, 5000. For example, central command unit 6000 may monitor the functioning of the high level computing device 1910 down to the low level ignition device 3240 both of FIG. 2.

Similarly, users at the central command unit 6000 can also actuate systems from the highest level of intelligence to lowest level of intelligence to perform desired duties. For example, central command unit 6000 can request that computing device 1910 turn boring head 3200 ten degrees to one side relative to its current position.

Alternatively, central command unit 6000 may directly calculate and direct the low level ignition firings of the individual ignition device 3240 to cause boring head 3200 to turn ten degrees to one side relative to its current position.

Central command unit 6000 can therefore operate any and all systems of the land units as remote robots allowing them to perform as much, or as little of the processing as desired.

Central command unit 6000 also has the capabilities to collect data not only from all of the land units, but from telemetry sensors and other control bases, which may be air, or land based. This is shown as the "network". Central command may therefore create images using data from a number of land units and other sources. Central command unit also knows the tasks which each land unit is trying to perform.

Central command unit may also determine which land units are disabled and destroyed. This becomes important in the reallocation section below.

Referring again to FIG. 2, sensor data is sent from communications unit 1030 to central command unit 6000 in this Remote Mode. The sensor data providing images and readings indicating to the remote operator the location, position, orientation, temperature, stresses, strains, forces, tank volumes and other relevant status information.

Communications device 1030 receives the transmitted commands and passes them to ether the computing unit 1910 or to data cables 2600 and ultimately to the proper actuator, based upon the preference of the user at the central command unit 6000.

3. Auto Mode

Referring to FIG. 1, in the Auto Mode, all of the functions of the land units 100, 4000, 5000 are self-directed and under the control of computing device 1910 of each land unit.

This mode does not require any outside commands or control. It also only relies upon it own stored or acquired imagery and does not 'see' what the other land units see.

It has its advantages in that it cannot be tricked by other entities trying to control the unit or set it on an incorrect course. Also, this may be the only mode in which the land units 100, 4000, 5000 can operate if its communications unit 1030 is destroyed or malfunctioning. This also may be the only mode that it can operate if it is in an inaccessible area and cannot receive communications from other land units or central command unit 6000.

Reallocation

1. Mixed Mode/2. Remote Mode

Referring now to FIG. 1, there is communication between the central control unit 6000 and the land units 100, 4000, 5000 in both the Mixed Mode and the Remote Mode. Therefore, in these modes, the Central Command Unit 6000 periodically assesses which land units 100, 4000, 5000 are functional. The Central Command Unit 6000 runs a quick health check to determine which are still functional ("live"). the central control unit 6000 determines inoperable land units. The central command unit 6000 then reallocates the tasks of inoperable land units 5000 to those which are operable 100, 4000 to ensure that all the tasks will be completed.

Just as described in the override function above, remote tests of functionality may be performed at various levels of system intelligence. For example, the ignition devices may be individually and directly checked as a low-level test. Similarly, tests may be requested from computing device 1910 which is capable of running tests of lower level equipment and reports the results of the tests to central command 6000.

Their locations and functional abilities are acquired. Some land units may have tracks giving them the ability to crawl on the ground, others may be able to ford streams, etc. The locations of known geographic features such as rivers, streams, lakes, ponds, mountains, Cliffs, forests, etc. are also acquired. Based upon the locations of the live units, their abilities and the geographic features, the Central command unit 6000 re-allocates regions to be imaged, and targets to bore toward, as well as other related instructions.

3. Auto Mode

If communications with central command unit 6000 is inoperable, such as in the case of RF interference or cross-talk, the land units 100, 4000, 5000 will default to the Auto Mode and continue to execute their last programmed instructions. In military applications, the communication channels may be intentionally jammed or another entity may be transmitting false or misleading information.

In Auto Mode, there would be no reallocation of assignments by the central command unit 6000. However, if several land units 100, 4000, 5000 are able to communicate with each other, they can reallocate tasks by themselves.

In Auto Mode reorganization, each of the land units transmits their health status and their location to the others. Each keeps track of this information and the signal strength of the land unit's communication and based upon these factors, votes to determine a master. The master may be determined from the remaining active land units in a random nature by land unit number. The master may be determined by the land unit with the best communication with the most other live units.

It may also be determined by indicating the one having the most complete data set. It may be the one with the fastest processing speed. The master then allocates tasks to the remaining land units.

In another alternative embodiment, there is no master, but the units interact as peers to correctly allocate tasks. In this case, each of the land unit may have all of the information of the system and each constantly updates the others as new information is acquired.

The present invention coordinates a plurality of land units to quickly locate and provide an access hole to one or more underground targets. These may be located in areas that are inaccessible to humans, due to the danger or hazardous environment. The present invention will function more quickly and accurately than the prior art devices.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A system [10] for rapidly boring through a material to a desired target location comprising:

a) central command unit [6000];

b) a plurality of ground units [100, 4000, 5000] for boring a hole to a target location, each unit having a platform [1000], umbilical subsystem [2000], a boring subsystem [3000] with a boring head having a plurality of combustion driven pulsejets [3100], a plurality of sensors [1810, 2810] and actuators [2100] throughout the system, and a computing unit [1910] adapted to operate in the following modes:

i. an auto mode in which the computing unit [1910] of each ground unit [100, 4000, 5000] performs any sensing and actuating functions;

ii. a remote-controlled mode in which the central command unit controls the computing unit [1910] and its sensing and actuation functions from a remote location; and iii. a mixed mode in which the computing unit [1910] of each ground unit [100, 4000, 5000] performs sensing and actuating functions, and the central command unit [6000] may remotely adjust or override the sensing and actuation functions.

2. The system [10] of claim 1 wherein at least part of the sensing functions includes sensing signals to image underground structures.

3. The system [10] of claim 1 wherein at least part of the sensing functions includes sensing positional signals from actuators [2100] on the ground unit [100, 4000, 5000].

4. The system [10] of claim 1 wherein at least part of the sensing operations includes sensing positional signals from actuators [2100] on the umbilical.

5. The system [10] of claim 1 wherein at least part of the sensing operations includes sensing positional signals from actuators [2100] on the boring head [3200].

6. The system [10] of claim 1 wherein at least part of the sensing operations includes sensing the status of actuators [1400, 1500, 1700, 1300, 1200, 1100] on the platform [1000].

7. The system [10] of claim 1 wherein at least part of the sensing operations includes sensing signals from sensors [2810] on the umbilical [2000].

8. The system [10] of claim 1 wherein at least part of the sensing operations includes sensing signals from sensors [3320] on the boring head [3200].

9. The system [10] of claim 1 wherein at least part of the sensing operations includes sensing temperature signals of the land unit [100, 4000, 5000].

10. The system [10] of claim 1 wherein at least part of the actuation functions includes pumping energetic fluid [7] from the ground unit platform [1000] down the umbilical [2000].

11. The system [10] of claim 1 wherein at least part of the actuation functions includes operating the electro-viscous fluid in the umbilical [2000] to cause the umbilical [2000] to function as desired.

12. The system [10] of claim 1 wherein at least part of the actuation functions includes activating crawling apparatus [2100] in the umbilical [2000] causing it to walk down the borehole [5].

13. The system [10] of claim 1 wherein at least part of the actuation functions includes operating the boring head [3200] to cause the desired boring in the proper direction.

14. A system [10] for rapidly boring through a material to a desired target location comprising:

a) central command unit [6000];

b) a plurality of ground units for boring a hole to a target location, each unit having a platform [1000], umbilical subsystem [2000], a boring subsystem [3000] with a boring head [3200] having a plurality of combustion driven pulsejets [3100], a plurality of sensors [1810, 2810] and actuators [2100] throughout the system, and a computing unit [1910] having initial pre-stored tasks to image a defined underground region and to bore to a defined underground location [1], the ground units capable of operating, for at least a portion of the time in a self-directed mode.

15. The system [10] of claim 14 wherein:

the central command unit [6000] is adapted to determine which land units [5000] are unable to perform its instructions, and which are able to perform their instructions, the central command unit [6000] is further adapted to provide new tasks to the land units [100, 4000] reallocating the tasks originally allocated to land units [5000] which can no longer perform its instructions.

16. The system [10] of claim 14 wherein:

the computing unit [1910] is adapted to operate in an additional auto mode allowing the ground units to communicate with each other and collectively determine which land units [5000] are disabled, and to interactively reallocate the initial pre-stored tasks on the disabled land unit [5000] to the remaining operable land units [100, 4000].

* * * * *